United States Patent [19]

Goldfarb et al.

[11] 4,113,255

[45] Sep. 12, 1978

[54] TOY GAME FOR MOVING AN OBJECT UP AN INCLINED SURFACE

[75] Inventors: Adolph E. Goldfarb, 4614 Monarca Dr., Tarzana, Calif. 91356; Erwin Benkoe, 17965 Medley Dr., Encino, Calif. 91316; Don Robinson, Manhattan Beach, Calif.

[73] Assignees: Adolph E. Goldfarb, Tarzana; Erwin Benkoe, Encino, both of Calif.

[21] Appl. No.: 770,186

[22] Filed: Feb. 18, 1977

[51] Int. Cl.[2] ..... A63B 67/00; A63F 9/00; A63H 17/04

[52] U.S. Cl. ..... 273/108; 46/202

[58] Field of Search ..... 273/108, 110, 1 R; 46/202

[56] References Cited

U.S. PATENT DOCUMENTS

| | | | |
|---|---|---|---|
| 1,174,411 | 3/1916 | Halton | 273/123 R |
| 1,339,343 | 5/1920 | Hulett | 273/123 R |
| 2,616,696 | 11/1952 | Field | 46/240 |
| 3,582,079 | 6/1971 | Breslow | 273/123 R |

FOREIGN PATENT DOCUMENTS

| | | | |
|---|---|---|---|
| 336,758 | 11/1903 | France | 273/123 R |
| 1,173,003 | 6/1964 | Fed. Rep. of Germany | 273/108 |
| 464,065 | 4/1937 | United Kingdom | 273/123 |

*Primary Examiner*—Richard C. Pinkham

*Assistant Examiner*—Lawrence E. Anderson

*Attorney, Agent, or Firm*—Robert M. Ashen; Robert J. Schaap

[57] ABSTRACT

A toy game for removing objects from a trough representative of a trash dump with self-propelled toy vehicle. The game is comprised of a game board with longitudinally spaced opposed player ends with a playing surface extending between the opposed player ends. The playing surface includes a trough in which removable objects are disposed and a pair of inclined walls extending upwardly and outwardly from the trough toward each of the opposed player ends. The objects located within the trough are irregularly shaped score-representing objects and are movable by a self-propelled toy vehicle, preferably in the characterization of a bulldozer. The players take turns positioning and aiming the toy vehicle on the inclined wall at their player end and permitting the toy vehicle to run down the inclined wall into the trough in an attempt to engage an object and move the object up the inclined wall at the opposed player end. The combination of the upward incline and the irregular shapes of the objects make moving the objects all the way up the incline difficult. The player who is successful in moving objects representing the highest score out of the trough and off of the opposed inclined wall wins the game.

19 Claims, 6 Drawing Figures

TOY GAME FOR MOVING AN OBJECT UP AN INCLINED SURFACE

BACKGROUND OF THE INVENTION

This invention relates in general to several new and useful improvement in toy games employing a self-propelled vehicle, and, more particularly, to toy games employing a self-propelled vehicle for moving an object up an inclined surface to achieve a score.

There are a number of well-known toy games involving movable simulated vehicles, such as automobiles, trucks and the like. In addition, there are a number of toys and toy games which utilize simulated characters capable of movement as for example, a walking type of movement.

One form of presently available toy games uses a simulated character having a pair of alternately shiftable legs capable of walking movement with each of the legs of the character alternately shifted in a forward movement to move the character. The toy figure is moved on a support surface which has one or more apertures in the support surface to receive a playing ball. The object of the game is to direct the figure in a direction to kick the ball during the walking movement into the one or more apertures in order to achieve a score.

However, applicants know of no toy game where a self-propelled vehicle moves into an object area for engaging a score-representing object and moving the same up an inclined wall to achieve a score.

OBJECTS OF THE INVENTION

It is, therefore, a primary object of the present invention to provide a game comprising a game board with an inclined surface and a self-propelled toy vehicle for moving one or more objects up the inclined surface in order to achieve a score.

It is another object of the present invention to provide a game of the type stated which includes a game board having a pair of longitudinally spaced apart opposed inclined surfaces at each of a pair of opposed player ends, and where opposed players take turns using a toy self-propelled vehicle to attempt to move objects up the opposite inclined surface to achieve scores.

It is further object of the present invention to provide a game of the type stated which employs a game board which can be folded into a relatively small compact unit, as for example a small box.

It is an additional object of the present invention to provide a game of the type stated which can be manufactured at a relatively low cost and which is relatively durable in its construction.

It is another salient object of the present invention to provide a game of the type stated in which relatively small children can learn to use skill in maneuvering and aiming a self-propelled toy vehicle in order to engage an irregularly shaped object and move the same up an inclined surface in order to achieve a score.

With the above and other objects in view, our invention resides in the novel features of form, construction, arrangement and combination of parts presently described and pointed out in the claims.

SUMMARY OF THE DISCLOSURE

The present invention provides a toy game which relies upon a self-propelled, simulated vehicle to push one or more objects from a trough and up an inclined surface in order to achieve a score. The illustrated game employs a game board with a centrally located trough having a plurality of irregularly sized and shaped score-representing objects located therein. The game board is also provided with a pair of outwardly and upwardly struck longitudinally extending inclined walls which extend from the trough and lead to each of a pair of longitudinally spaced apart opposed player ends.

In a preferred aspect of the present invention, ramps may be provided at each of the opposed ends of the inclined walls to permit the toy vehicle to push the object down the ramp. The toy vehicle is provided with a motor such as a spring wound or intertial motor for self-propelling movement.

The objects located in the trough preferably have different sizes and shapes such that some of the objects which are harder to move out of the trough and up an inclined wall have a greater scoring value than other of the objects.

In the play of the game, each player takes a turn in letting the self-propelled vehicle move down the inclined wall at that player's end. The vehicle is aimed so that it will engage an object and push the object up the inclined wall at the opposed player's end. A score is achieved when the vehicle pushes an object up the wall and over the end thereof.

The fact that the objects are being pushed up an inclined surface over a substantial distance relative to the size of the toy vehicle and the size and shape of the objects adds to the difficulty of the play. In a preferred mode of playing the game, the direction of the toy vehicle cannot be changed after it is aimed and released by a player, thereby also increasing the difficulty of play. Moreover, the front end of the toy vehicle is relatively flat as in the shape of a bulldozer so that the object can easily fall off if it was not initially engaged in just the right way. The term "irregular" generally refers to any object shape which is not spehrical or approaching spherical such that it will roll like a ball. Thus, the object may have rounded or curved portions as for example a cylindrical tube and still be deemed irregular in shape.

In one simple and economical form, the trough, inclined walls and ramps may all be integrally formed from a single piece of folded material such as cardboard. The trough and inclined walls may be received in an upwardly open box structure, with the upright wall ends of the box supporting the elevated ends of the inclined walls and the upright side walls of the box forming side retaining rails for the trough and inclined walls.

BRIEF DESCRIPTION OF THE DRAWINGS

Figures 1, 2, 3, 4:
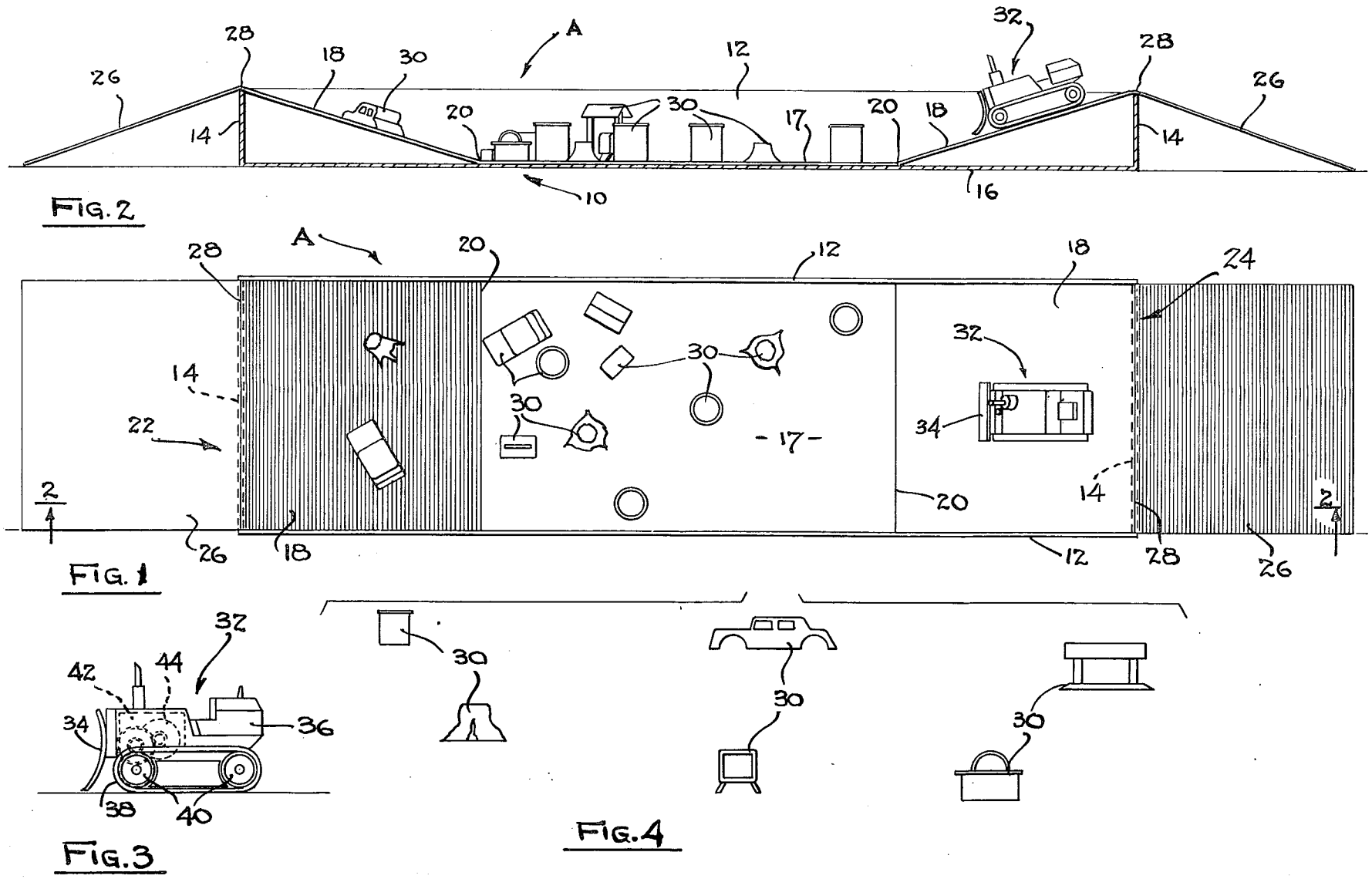
Figure 5:
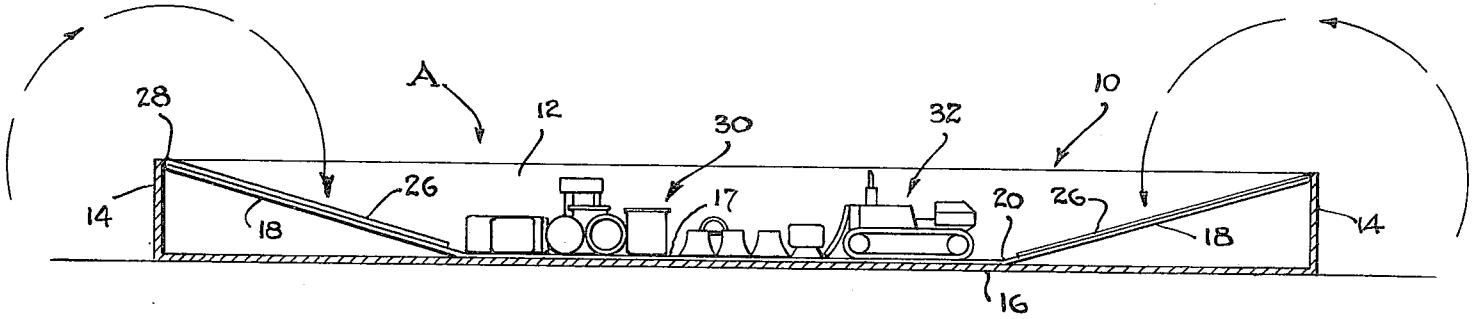
Figure 6:
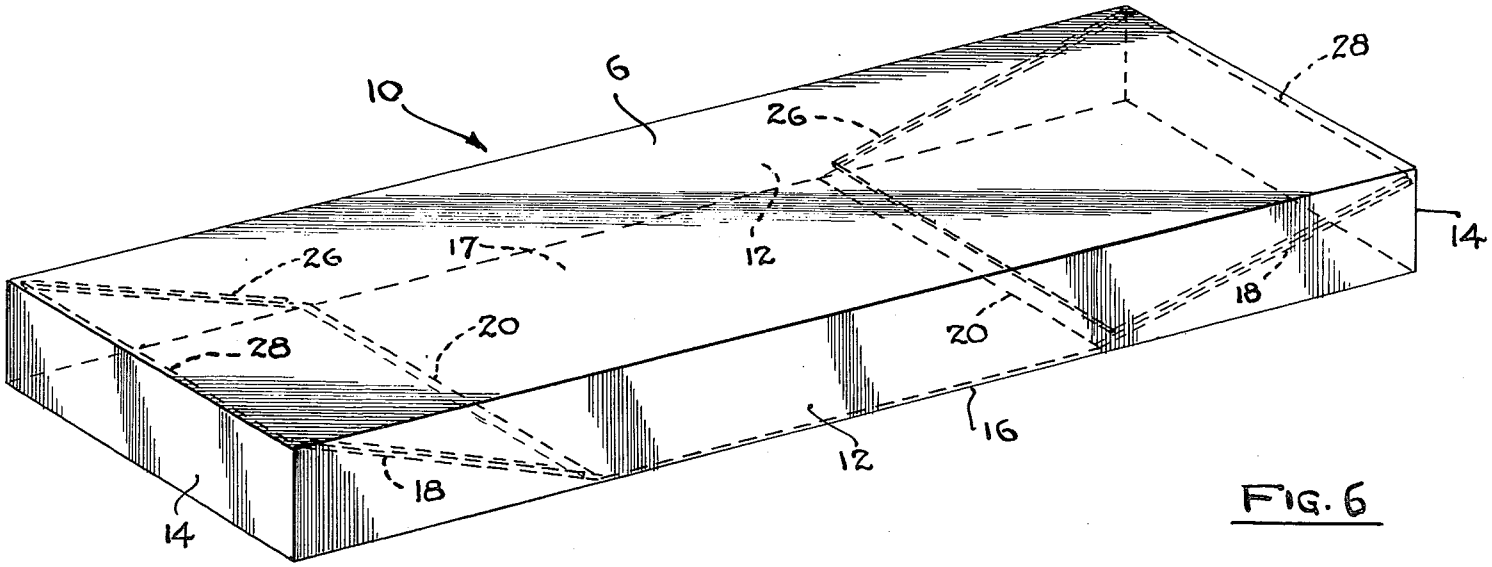

Having thus described the invention in general terms, reference will now be made to the accompanying drawings in which:

FIG. 1 is a top plan view of a toy playing game constructed in accordance with and embodying the present invention;

FIG. 2 is a vertical sectional view of the toy playing game of FIG. 1 taken along line 2—2 of FIG. 1;

FIG. 3 is a side-elevational view, partially in dotted lines, and showing a toy vehicle used in the game for moving an object up an inclined wall;

FIG. 4 is a composite view of several of the objects used in the toy game of the present invention;

FIG. 5 is a side elevational view, partially in section, and showing the game housing of the toy game in the folded condition; and FIG. 6 is a perspective view, partially shown in dotted lines and showing the game housing in the folded condition with a lid thereon.

DETAILED DESCRIPTION OF THE PREFERRED EMBODIMENT

Referring now in more detail and by reference characters to the drawings which illustrate a practical embodiment of the present invention, A designates a playing game comprised of a box-like housing 10, in the manner as more fully illustrated in FIGS. 1 and 2.

The housing 10 comprises a pair of longitudinally extending, transversely spaced apart, upstanding side walls 12 which are connected at their transverse ends by upstanding end walls 14, preferably in a rectangular configuration. The housing is also provided with a bottom wall section 16. Coextensive with the mid portion of bottom wall 16 and lying between the two longitudinally extending side walls 12 at the lower edges thereof is an inner sheet 17 which integrally merges into a pair of upwardly and outwardly inclined walls 18. In this respect, it can be observed that one of the inclined walls 18 is integral with and foldably connected to the one transverse end of the sheet 17 through a foldline 20 and the other of the inclined walls 18 is similarly integrally and foldably connected to the other transverse end of the sheet 17 through a similar foldline 20. The inclined walls 18 extend to the upper edge of the upstanding transverse end walls 14 and thereby define a pair of opposed player ends 22 and 24.

Integrally connected to the upper ends of the inclined walls 18 are downwardly and outwardly extending ramps 26 at each of the player ends and which are connected to the inclined walls 18 through foldlines 28. In this respect, it can be observed that the upwardly and outwardly inclined walls 18 could be connected to the lower sheet 17 through a hinged connection, and, in like manner, the ramps 26 could be connected to the upper ends of the inclined walls 18 through hinged connections.

The housing 10 is preferably formed of a paperboard material which may be corrugated, particularly in the side and end wall sections thereof, for greater strength. In the construction, the inclined walls 18 would be connected to the lower sheet 17 through a hinged connection integrally formed in the paperboard material. In the same manner, the ramps 26 would also be connected to the upper ends of the inclined walls 18 through hinged connections. However, it should be understood that the housing 10, as well as the various other components forming part of the game of the present invention, may be constructed of any of a number of known plastic materials or other materials and in which case the various components could be connected to each other with hinge means. Those plastic materials which may be used to construct the housing include polyethylene, polystyrene, many of the vinylidene polymers and copolymers, and various other moldable plastics which are known in the art. In addition, the housing 10 and the other components forming part of the game may be formed in any of a number of known plastic-forming operations including thermo-forming, blow-molding, injection molding and the like. Nevertheless, it should also be understood that the housing 10, as well as these components forming part of the game, could be formed of other structural materials such as various known sheet metals including aluminum, steel and the like, and which could be made in a number of well-known sheet metal forming operations.

By further reference to FIG. 2, it can be observed that the lower sheet 17, along with the inclined walls 18, form a trough for receiving score-representing objects 30, to be described in more detail hereinafter. Moreover, it can be observed that the ramps 26 are folded over to lie upon the upper surfaces of the inclined walls 18 in a flat juxtaposed position so that the housing 10 can be folded into a small compact unit. In this way, the housing 10 forms a small box. A suitable cover 6 is normally provided with the playing game for fitting over the open upper end when in the folded condition as shown in FIGS. 5 and 6.

It can also be observed that the trough and inclined walls could adopt the form of a parabolic shape or a somewhat semicylindrical shape. In the same respect, the bottom wall could also be curved so that it is concave downwardly. Thus, the inclined walls could also be slightly curved in order to increase the difficulty in moving the objects up the walls. It should also be understood that a curved inclined wall is still nevertheless an inclined wall in the same sense as the inclined walls illustrated herein.

The score-representing objects 30 are generally irregular in shape, as defined above, so that they will not easily roll down the inclined walls 18. In this respect, it can be observed that any spherical object or an object almost approaching a spherical configuration will easily roll on the inclined walls 18 so that it would be difficult for any powered mechanism to push these objects up the inclined walls. The objects are preferably in the shape of "trash" objects, as for example, old tires, barrels, boxes, and the like. In this respect, the game of the present invention can be designed in the form of a "town dump" in which the town dump would include objects simulating actual objects normally found in a town dump. However, it should be understood that other objects could be used for providing other forms of game play.

Also provided for use with the toy game of the present invention is a self-propelling vehicle 32 which is preferably designed with a characterization of a bulldozer. The toy vehicle 32, when energized, is capable of moving down one of the inclined walls 18 at one of the player's ends and into the trough section encompassed by the flat inner sheet 17 so as to engage an object 30 therein. The vehicle is aimed by a player so that it engages and attempts to push an object 30 up the inclined wall 18 at the opposite player end. The objects 30 have different shapes and each are assigned score values depending on the degree in difficulty in moving the object up the inclined walls. Thus, objects which are more difficult to move will have a higher score value.

If the vehicle is capable of retaining and moving the object 30 up the inclined wall 18 and over the upper end thereof so as to push the object 30 down the ramp 26 at the opposed player end, then the player who initially started the vehicle will achieve a score. The score achieved by the player who originally started the movement of the vehicle 32 will depend on the type of object which has been removed from the trough and outwardly from the inclined wall beyond the opposed player end. In this respect, and as indicated previously, the score-representing objects 30 should be irregular in shape so that they will not easily roll down the inclined wall 18. However, the shapes of the objects 30 are such that they will be capable of being engaged by the front plate of a bulldozer-type vehicle so as to be pushed up the inclined wall 18 to the upper end thereof.

Any form of self-propelled vehicle may be used in the present invention. On one of the preferred embodiments of the present invention, the vehicle is provided with an inertial motor so that a drive wheel on the underside of the vehicle is rotated at a sufficient speed in order to provide an inertial energy in the vehicle in order to self-propel the vehicle for a sufficient distance. Other forms of motors may also be used in connection with the present invention, as for example, a spring wind-up motor, a battery-powered motor or the like. In this respect, many of the components forming part of the vehicle, as well as the objects, could also be formed of those materials as described above.

FIG. 3 more fully illustrates a toy vehicle in the form of a bulldozer and which includes a body 36 having a driving track 38 trained about a pair of wheels 40, one of which constitutes a driving wheel. In this case, it can be observed that the driving wheel is connected through a pinion gear assembly 42 to a motor, such as an electric battery powered motor 44. The front end of the bulldozer vehicle 32 is provided with a scoop 34. However, as indicated previously, any other form of drive mechanism could be used in the bulldozer, and, for that matter, other forms of vehicles could be used in the present invention.

The objects 30 are sufficiently irregular in shape so that they will not easily roll down the incline, but also, they are of such shape so that they are difficult to move and keep in front of the vehicle. Otherwise, if the vehicle is not properly aimed when movement starts, the vehicle will not properly engage the object in a manner sufficient to push it to the top of the inclined wall at the opposed player end and the object will thereupon become disengaged from the vehicle and roll down the inclined wall 18. FIG. 4 shows various forms of objects which can be used in the game of the present invention.

In accordance with the preferred mode of playing the game, those objects which are harder to push out of the trough will be assigned a higher scoring value than other objects which are easier to push out of the trough as indicated above. In this way, the players can select the particular objects they wish to remove from the trough and locate the vehicle in a proper position so as to roll down the incline at its player end, engage the object and push the object up and over the inclined wall at the opposed player end.

Thus, there has been illustrated and described a unique and novel playing game where a toy vehicle engages an object and attempts to move the object up an inclined wall in order to achieve and score and which therefore fulfills all of the objects and advantages sought therefor. It should be understood that many changes and modifications and other uses and applications of the present invention will become apparent to those skilled in the art after considering this specification and the accompanying drawings. Therefore, any and all such changes and modifications and variations and other uses and applications which are not apparent to those skilled in the art will be deemed to be covered by the invention which is limited only by the following claims.

Having thus described our invention, what we desire to claim and secure by Letters Patent is:

1. A toy game for removing objects from a trough with a toy vehicle, said toy game comprising:

(a) a playing board comprised of
  (1) a pair of opposed player ends,
  (2) an upper playing surface extending between said player ends, said playing surface having an upwardly and outwardly inclined wall at each of said opposed player ends with a central trough therebetween, (b) a plurality of score representing objects located on said playing surface, (c) a self-propelled toy selectively positionable at a player end, said toy vehicle being operable to move down the inclined wall at such player end and to engage one of said objects and move the same up the inclined wall at the opposed player end to achieve a score, and (d) a pair of ramps each connected to an inclined wall at one of the player ends and inclined downwardly and outwardly therefrom to enable an object moved up the inclined wall at a player end to be pushed by the vehicle down the associated ramp.

2. The toy game of claim 1 further characterized in that an upstanding rail extends along a portion of said playing board.

3. The toy game of claim 2 further characterized in that said player ends are longitudinally spaced from each other, and said upstanding rail extends longitudinally on each of the longitudinal margins of said playing board.

4. The toy game of claim 3 further characterized in that said trough is a relatively flat bottom wall extending between the lower ends of said inclined walls.

5. The toy game of claim 3 further characterized in that said trough is a generally curved bottom wall extending between said lower ends of said inclined walls.

6. The toy game of claim 1 further characterized in that said trough represents a trash dump and the objects represent articles of trash.

7. The toy game of claim 1 further characterized in that said objects are irregular in shape so as to increase the difficulty in removing the objects from the playing surface.

8. The toy game of claim 1 further characterized in that said toy vehicle includes a body supporting a motor and energy-storage means.

9. The toy game of claim 8 further characterized in that said motor is an inertia motor.

10. A toy game for removing objects from a trough with a toy vehicle, said toy game comprising:

(a) a playing board comprised of
  (1) a pair of opposed player ends,
  (2) an upper playing surface extending between said player ends, said playing surface having an upwardly and outwardly inclined wall at each of said opposed player ends with a central trough therebetween, (b) a plurality of score representing objects located on said playing surface, (c) a self-propelled toy selectively positionable at a player end, said toy vehicle being operable to move down the inclined wall at such player end and to engage one of said objects and move the same up the inclined wall at the opposed player end to achieve a score, said toy vehicle including a body supporting a spring wound motor and an energy storage means in the form of a spring.

11. A toy game for removing objects from a trough with a toy vehicle, said toy game comprising:

(a) a playing board comprised of (1) a pair of opposed player ends, (2) an upper playing surface extending between said player ends, said playing surface having an upwardly and outwardly inclined wall at each of said opposed player ends with a central trough therebetween, (b) a plurality of score representing objects located on said playing surface, (c) a self-propelled toy selectively positionable at a player end, said toy vehicle being operable to move down the inclined wall at such player end and to engage one of said objects and move the same up the inclined wall at the opposed player end to achieve a score, said vehicle including a body supporting a battery operated motor and an energy storage means in the form of a battery.

12. A toy game for removing objects from a trough with a toy vehicle, said toy game comprising:

(a) a game housing comprised of (1) a generally rectangular peripherally extending upstanding side wall and being comprised of four side wall sections with each having an upper margin thereon, (2) a bottom wall section extending between a portion of two of said side wall sections and being located below the upper margin on said portion of the side wall sections, (3) upwardly and outwardly inclined wall sections extending from said bottom wall section to the upper margin of the remaining two of said side wall sections, with said latter two side wall sections representing player ends, said bottom wall section being integral with an representing a trough between said inclined wall sections, (b) a self-propelled separate mechanism selectively positionable at a player end, said mechanism being operable to move down the inclined wall section at such player end and to engage one of the objects and move the same up the inclined wall section at the opposed player end to achieve a score when the object reaches a determined position on such inclined wall section, and (c) a pair of ramps each connected to an inclined wall section at one of the player ends and inclined downwardly and outwardly therefrom to enable an object moved up the inclined wall section at a player end to be pushed by the mechanism down the associated ramp.

13. The toy game of claim 12 further characterized in that said objects are irregular in shape so as to increase the difficulty in removing the objects from the trough.

14. The toy game of claim 12 further characterized in that said first two named side wall sections are opposed longitudinally extending side wall sections and said latter two named side wall sections are opposed transverse side wall sections, and that said inclined wall sections extend to the upper margins of said transverse side wall sections, said transverse side wall sections being shorter than said longitudinal side wall sections.

15. The toy game of claim 12 further characterized in that said bottom wall section, inclined wall sections, and ramps are integrally formed from a continuous folded strip of foldable sheet material.

16. The toy game of claim 15 further characterized in that each of said transverse side wall sections supports the portion of said strip at a place where it is elevated to form the upper ends of an inclined wall section and a ramp.

17. The toy game of claim 16 further characterized in that said side wall is connected to a generally rectangular base wall.

18. The toy game of claim 12 further characterized in that said self-propelled mechanism is in the form of a toy vehicle.

19. The toy game of claim 18 further characterized in that said toy vehicle includes a body supporting a motor and energy-storage means.

* * * * *